US008052318B2

(12) United States Patent
Lee et al.

(10) Patent No.: US 8,052,318 B2
(45) **Date of Patent: *Nov. 8, 2011**

(54) LIGHT GUIDE MEMBER AND KEYPAD ASSEMBLY USING THE SAME

(75) Inventors: Joo-Hoon Lee, Gyeonggi-do (KR); Gwan-Hyung Kim, Seoul (KR)

(73) Assignee: Samsung Electronics Co., Ltd., Maetan-dong, Yeongtong-gu, Suwon-si, Gyeonggi-do (KR)

( * ) Notice: Subject to any disclaimer, the term of this patent is extended or adjusted under 35 U.S.C. 154(b) by 0 days.

This patent is subject to a terminal disclaimer.

(21) Appl. No.: 13/038,521

(22) Filed: Mar. 2, 2011

(65) Prior Publication Data

US 2011/0149573 A1 Jun. 23, 2011

Related U.S. Application Data

(63) Continuation of application No. 12/041,706, filed on Mar. 4, 2008, now Pat. No. 7,959,342.

(30) Foreign Application Priority Data

Mar. 14, 2007 (KR) ..... 2007-24922

(51) Int. Cl.
*F21V 7/04* (2006.01)

(52) U.S. Cl. ..... 362/617; 362/610; 362/623; 200/314

(58) Field of Classification Search ..... 362/26, 362/27, 610, 615, 617–619, 623–625, 627, 362/629; 200/314
See application file for complete search history.

(56) References Cited

U.S. PATENT DOCUMENTS

| | | | | |
|---|---|---|---|---|
| 5,746,493 | A * | 5/1998 | Jonsson et al. | 362/602 |
| 6,026,283 | A * | 2/2000 | Stephenson | 455/575.1 |
| 2007/0012553 | A1 | 1/2007 | Lee et al. | |

FOREIGN PATENT DOCUMENTS

| | | |
|---|---|---|
| CN | 1217079 | 5/1999 |
| CN | 1769933 | 5/2006 |
| CN | 1866439 | 11/2006 |
| JP | 09-281341 | 10/1997 |
| JP | 2001-255416 | 9/2001 |
| JP | 2003-177250 | 6/2003 |
| JP | 2004-319364 | 11/2004 |
| KR | 2002-60550 | 7/2002 |
| KR | 2006-117699 | 11/2006 |
| WO | WO 2007/024213 | 3/2007 |

* cited by examiner

*Primary Examiner* — Thomas Sember
(74) *Attorney, Agent, or Firm* — Cha & Reiter, LLC

(57) ABSTRACT

Disclosed are a light guide member and a keypad assembly including the same. The light guide member includes a light guide plate for guiding light propagated inside, and at least one recess formed in a direction perpendicular to a direction of guidance of light coupled to the inside of the light guide plate so that light guided by the light guide plate is reflected to the light guide plate. The keypad assembly includes a keypad having at least one key button and an elastic sheet fixing the key button, a light guide member positioned beneath the keypad, the light guide member having a light guide plate for guiding light coupled to an inside and at least one recess for reflecting light guided by the light guide plate to the light guide plate, and a switch pad positioned beneath the light guide member so as to establish an electric contact when the key button is pressed.

14 Claims, 7 Drawing Sheets

LIGHT GUIDE MEMBER AND KEYPAD ASSEMBLY USING THE SAME

CROSS RELATED APPLICATION(S)

This application is a Continuation Application of U.S. Ser. No. 12/041,706, filed Mar. 4, 2008 now U.S. Pat. No. 7,959,342, which claims priority to Korean Application No. 2007-24922 filed Mar. 14, 2007, all of which are hereby incorporated by reference.

BACKGROUND OF THE INVENTION

1. Field of the Invention

The present invention relates to a keypad and a keypad assembly, and more particularly to a keypad and a keypad assembly including a light guide member having a light guide plate.

2. Description of the Related Art

In general, keypad assemblies are used as information input means for users of personal computers, portable wireless terminals, automatic machinery, etc. Conventional keypad assemblies include a keypad and a switch pad.

The keypad includes a number of key buttons having characters, numerals, and symbols printed thereon, and an elastic sheet having the key buttons fixed to its upper surface. The switch pad includes a printed circuit board (PCB) having a plurality of electric contacts formed thereon, and a dome sheet attached to the PCB.

When a user presses one of the key buttons, pressure is applied to the corresponding dome of the dome sheet via the elastic sheet. Then, the dome is deformed and electrically connected to the corresponding electric contact. Based on the electric connection between the dome and the electric contact, the device (e.g. personal computer, portable wireless terminal, or automatic machinery having the keypad assembly mounted thereon) recognizes that information selected by the user has been inputted.

Keypad assemblies mounted on portable wireless terminals have additional rear lighting means positioned near the key buttons. This enables users to operate the devices even when there is no lighting available.

The rear lighting means come in various types, including: (1) having a plurality of LEDs mounted on the switch pad so as to directly illuminate key buttons, (2) adopting a light emitting structure based on organic light emitting substances, and (3) employing light guide members.

However, conventional rear lighting means have a number of limitations, including that although they are supposed to illuminate key buttons, a considerable amount light is directed to the periphery and then lost. This is an obstacle to making portable terminals that consume less power and that are compact.

SUMMARY OF THE INVENTION

Accordingly, the present invention has been made to solve the above-mentioned problems occurring in the prior art. The present invention provides a keypad assembly including a light guide plate adapted to minimize the leakage and loss of light coupled to the inside of the light guide plate.

In according to one aspect of the present invention, a light guide member including a light guide plate for guiding light coupled to an inside is provided and at least one recess is formed in a direction perpendicular to the direction of guidance of light coupled to the inside of the light guide plate, so that light guided by the light guide plate is reflected to the light guide plate.

In accordance with another aspect of the present invention, a keypad assembly including a keypad having at least one key button and an elastic sheet fixing the key button is provided, a light guide member is positioned beneath the keypad, the light guide member having a light guide plate for guiding light coupled to the inside and at least one recess for reflecting light guided by the light guide plate to the light guide plate, and a switch pad positioned beneath the light guide member so as to establish an electric contact when the key button is pressed.

BRIEF DESCRIPTION OF THE DRAWINGS

The present invention will be more apparent from the following detailed description taken in conjunction with the accompanying drawings, in which.

DETAILED DESCRIPTION OF THE INVENTION

Hereinafter, embodiments of the present invention will be described in detail with reference to the accompanying drawings. For the purposes of clarity and simplicity, a detailed description of known functions and configurations incorporated herein is omitted to avoid making the subject matter of the present invention unclear.

Figure 1A:
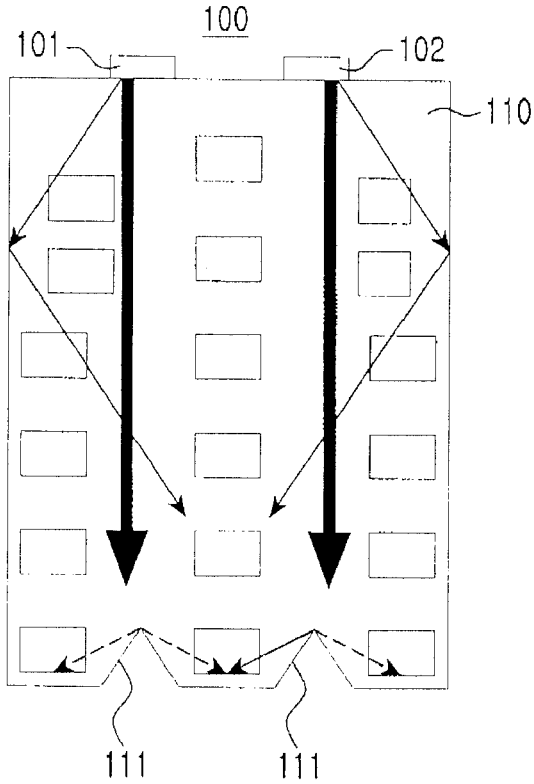
FIGS. 1*a* to 1*c* show light guide members according to a first embodiment of the present invention.
Figure 1B:
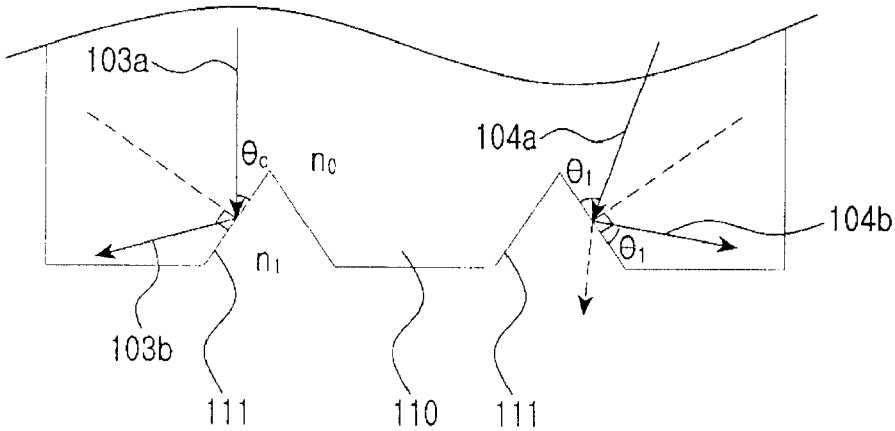

FIGS. 1*a* and 1*b* show a light guide member according to a first embodiment of the present invention. The light guide member 100 includes a light guide plate 110 for guiding light coupled to its inside, at least one recess 111 formed in a direction perpendicular to the direction in which light coupled to the inside of the light guide plate 110 is guided so that incident light from the light guide plate 110 is reflected to the light guide plate 110, and light sources 101 and 102 for creating light.

The light guide plate 110 guides light coupled to its inside so that the coupled light propagates from the first lateral surface of the light guide plate 110 to its second lateral surface. As used herein, the first lateral surface of the light guide plate 110 refers to one of its lateral surfaces to which light from the outside is coupled. The light guide plate 110 may have any shape, such as a square or other geometrical shape. After being coupled to the inside of the light guide plate 110, light undergoes total reflection at the interface between the light guide plate 110 and its external air layer and propagates inside the light guide plate 110.

The light guide plate 110 may be made of a polymer having low hardness, high elastic deformability, high restoration capability, and high optical transmittance, such as polycarbonate, PMMA (polymethylmethacrylate), polyurethane, or silicone.

The recess 111 is formed in a direction perpendicular to the direction in which light coupled to the inside of the light guide plate 110 is guided so that incident light from the light guide plate 110 is reflected to the inside of the light guide plate 110. Particularly, the recess 111 may be an indentation formed on a part of the second lateral surface so as to provide the light guide plate 110 with an interface between itself and its external air layer.

When light is guided by the light guide plate 110 and is incident towards the recess 111, it is reflected towards the light guide plate due to the difference in refractive index between the light guide plate 110 and the external air layer.

The section in a direction perpendicular to the direction in which light is guided by the recess 111 may have the shape of a semi-circle, a circle, or an ellipse, which has a predetermined curvature, or a polygon. Alternatively, the recess 111 may extend into the light guide plate 111 along the second lateral surface.

Although the recess 111 shown in FIG. 1*a* has the shape of an indentation formed on a part of the second lateral surface of the light guide plate 110, it may be a hole extending through the light guide plate 110. Alternatively, recesses 111 may be indentations formed on parts of the upper and lower surfaces of the light guide plate 110.

FIG. 1*b* partially magnifies the light guide plate 110 shown in FIG. 1*a*, which has recess 111 formed thereon. As shown in FIG. 1*b*, when light 103*c* is incident on the recess 111 at a critical angle $\theta_c$, it is totally reflected to the inside of the light guide plate 110. When light 104*a* is incident at an angle larger than the critical angle $\theta_c$, a portion of it (indicated by a solid line) passes through the recess 111 and leaks out. The remaining portion 104*b* is reflected to the inside of the light guide plate. Some light scatters at the interface defined by the recess and is lost.

The refractive index $n_1$ of air is 1, and is used as a reference to be compared with the refractive index of other substances. The refractive index $n_0$ of the light guide plate 110 is higher than the refractive index $n_1$ of the air layer.

According to the present embodiment, at least one recess 111 is formed along the propagation path of light guided from the first lateral surface of the light guide plate 110 to its second lateral surface, or on the second lateral surface so as to provide an interface between the light guide plate and the air layer, which have different refractive indices. Therefore, light incident towards the recess 111 is reflected to the inside of the light guide plate 110 due to the difference in refractive index between the light guide plate 110 and the air layer.

When light incident on the recess 111 satisfies the condition of total reflection, the majority of light is reflected to the inside of the light guide plate 110 except for a fraction of light lost after scattering at the interface. If the condition of total reflection is not satisfied (i.e. if the incident angle is larger than the critical angle), a portion of light passes through the recess 111, but the remaining portion is reflected to the inside of the light guide plate 110.

Therefore, the recess 111 minimizes the loss of light occurring when light coupled to the inside of the light guide plate 110 leaks out.

Figure 1C:
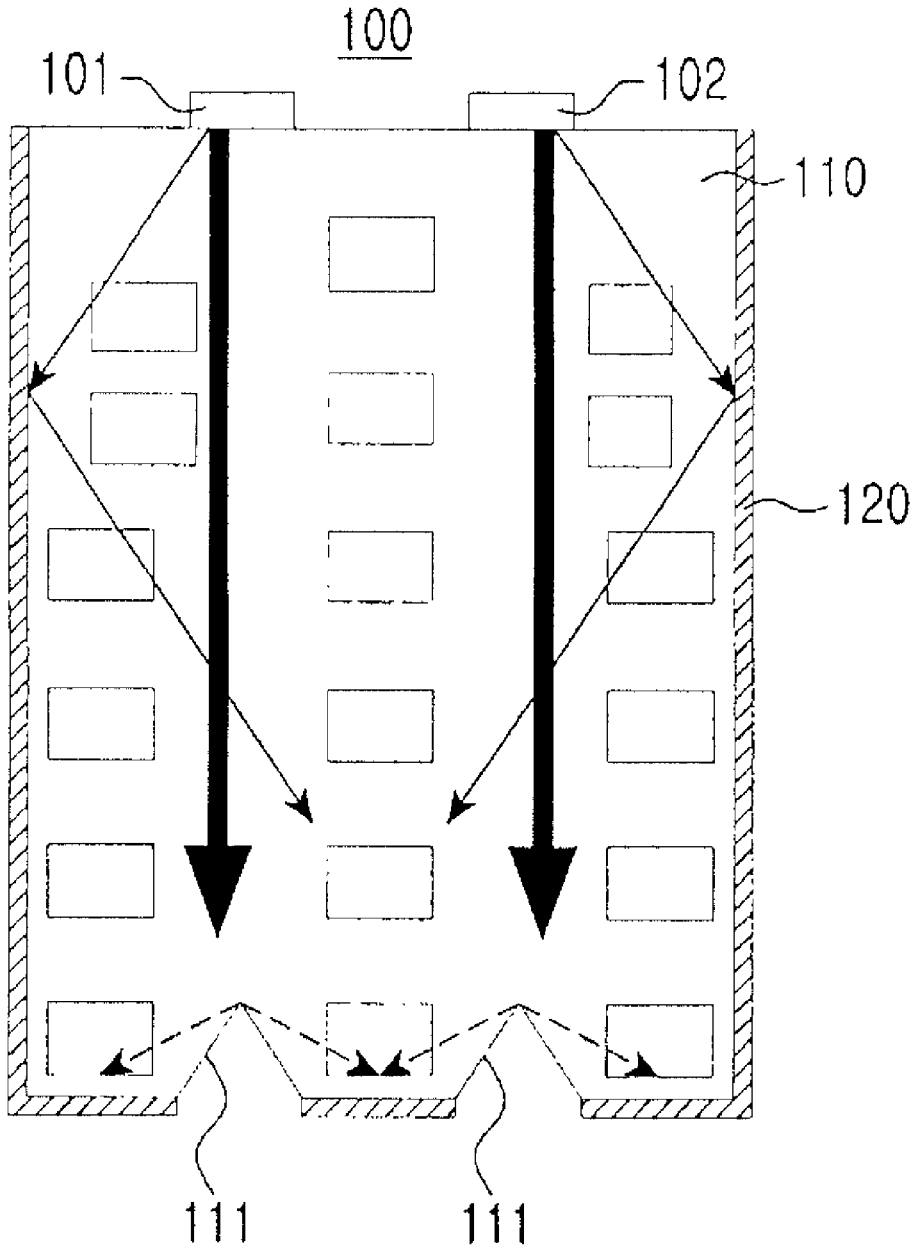

Referring to FIG. 1*c*, the light guide plate 110 shown in FIG. 1*a* has a light blocking layer 120 printed around its second lateral surface. In particular, the light blocking layer 120 is printed around the first lateral surface, which faces the light sources 101 and 102, and the second lateral surface, on which the recess 111 is formed. The light blocking layer 120 may be made of block ink, for example, in order to prevent light from leaking out of the light guide plate 110. As shown in FIG. 1*c*, the recess 111 preferably has no light blocking layer 120 formed thereon.

Figure 2A:
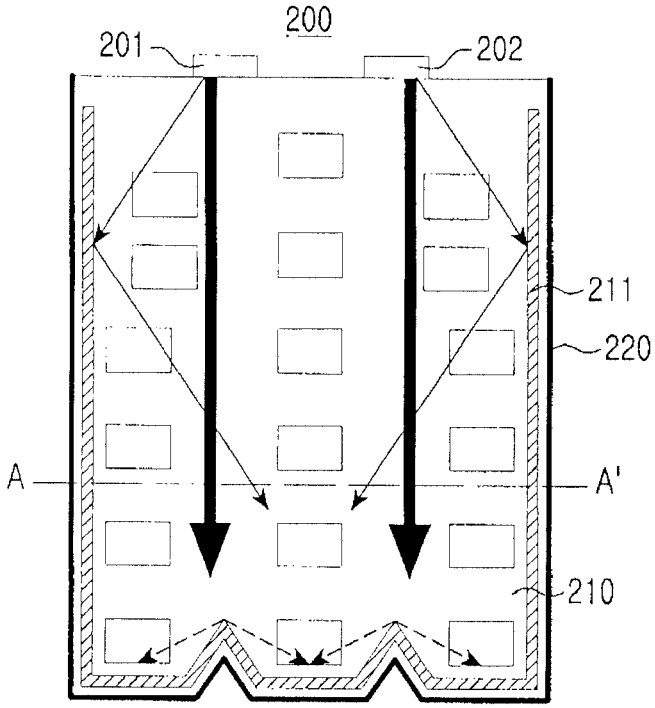
FIGS. 2*a* to 2*c* show light guide members according to a second embodiment of the present invention.

FIG. 2*a* shows a light guide member according to a second embodiment of the present invention. The light guide member 200 includes a light guide plate 210 for guiding light, which has been coupled to the inside via the first lateral surface, towards the second lateral surface, at least one light source 201 and 202 for outputting light to the first lateral surface of the light guide plate 210, at least one recess 211 formed on the light guide plate 210, and a light blocking layer 220 formed around the second lateral surface of the light guide plate 210.

In the following description of the light guide member 200 according to the second embodiment of the present invention, detailed descriptions of the same components and operations as in the case of the first embodiment of the present invention will be omitted for brevity.

Figure 2B:
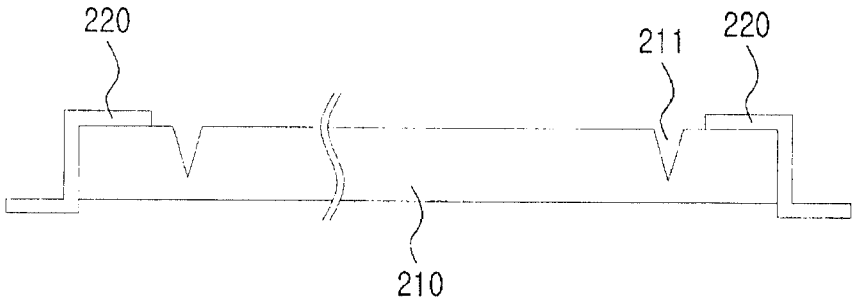
Figure 2C:
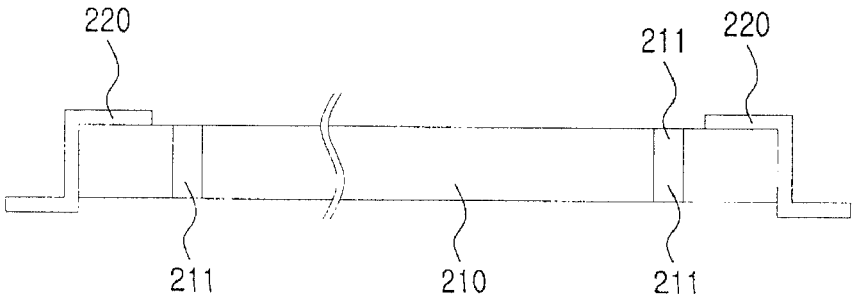

The recess 211 may be formed along the second lateral surface inside the light guide plate 210 so that light guided from the first lateral surface is reflected to the inside of the light guide plate 210. As shown in FIG. 2*b*, the recess 211 may be an indentation formed by scratching the upper surface of the light guide plate 210 along the light blocking layer. As shown in FIG. 2*c*, alternatively, the recess 211 may be a hole extending through the upper and lower surfaces of the light guide plate 210.

As shown in FIGS. 2*a* to 2*c*, the light blocking layer 220 may be formed along the second lateral surface of the light guide plate 210 by printing. The light blocking layer 220 absorbs a portion of light, which has passed through the recess 211 without reflection, and prevents unnecessary leakage of light out of the light guide plate 210. Although the light blocking layer 220 is commonly made of black ink, white link may be used to print the inner surface of the light blocking layer 220, which abuts the second lateral surface of the light guide plate 210.

Figure 3:
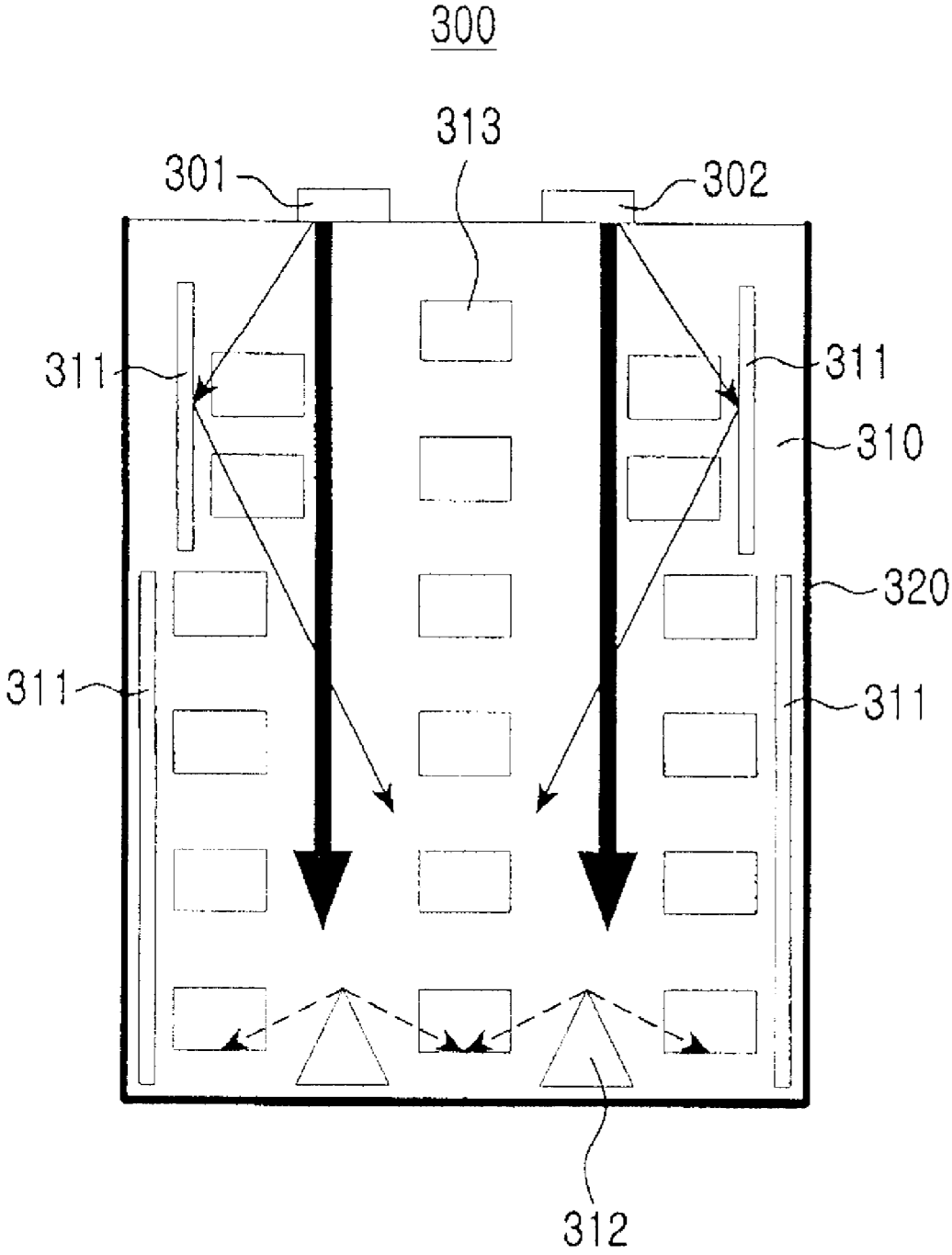
FIG. 3 shows a light guide member according to a third embodiment of the present invention.

FIG. 3 shows a light guide member according to a third embodiment of the present invention. Referring to FIG. 3, the light guide member 300 includes a light guide plate 310 for guiding light, which has been coupled to the inside via the first lateral surface, to the second lateral surface, at least one recess 311 formed on the light guide plate 310, a light blocking layer 320 formed along the second lateral surface of the light guide plate 310, and light sources 301 and 302 for creating light to be coupled to the inside of the light guide plate 310.

In the following description of the light guide member 300 according to the third embodiment of the present invention, detailed descriptions of the same components and operations as in the case of the first and second embodiments of the present invention will be omitted for brevity.

The recess 311 may be locally formed on a part adjacent to the second lateral surface of the light guide plate 310. Alternatively, the recess 311 may be a hole extending through the light guide plate 310 or an indentation formed by scratching.

The light blocking layer 320 may be formed on the second lateral surface of the light guide plate 310 by printing, for example, so as to absorb a portion of light that has passed through the recess 311.

Figure 4A:
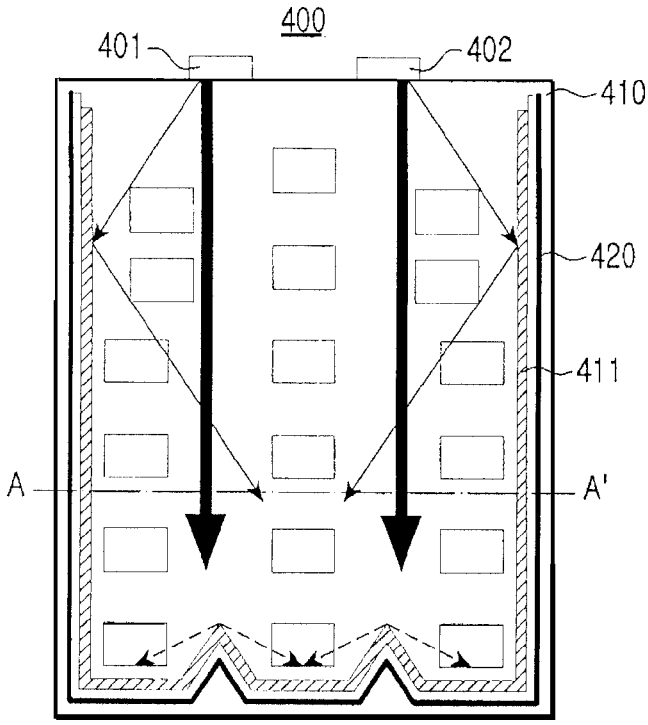
FIGS. 4*a* to 4*e* show light guide members according to a fourth embodiment of the present invention.

FIG. 4*a* shows a light guide member 400 according to a fourth embodiment of the present invention. FIGS. 4*b* to 4*e* show exemplary sections taken along A-A' shown in FIG. 4*a*, respectively. The light guide member 400 according to the present embodiment includes a light guide plate 410 for guiding light, which has been coupled to the inside via the first lateral surface, towards the second lateral surface, at least one recess 411 formed on a part of the light guide plate 410, a light blocking layer 420 formed on the light guide plate 410 along the second lateral surface, and light sources 401 and 402 for creating light to be coupled to the inside of the light guide plate 410. The light sources 401 and 402 are positioned so that their light emitting surfaces face the first lateral surface of the light guide plate 410.

In the following description of the light guide member 400 according to the fourth embodiment of the present invention, detailed descriptions of the same components and operations as in the case of the first, second, and third embodiments of the present invention will be omitted for brevity.

The light guide member 400 according to the present embodiment has a light blocking layer 420 printed inside the light guide plate 410 along the recess 411. The light blocking layer 420 absorbs light, which has passed through the recess 411 without being reflected to the light guide plate 410, and minimizes the leakage of light out of the light guide plate 410.

Figure 4B:
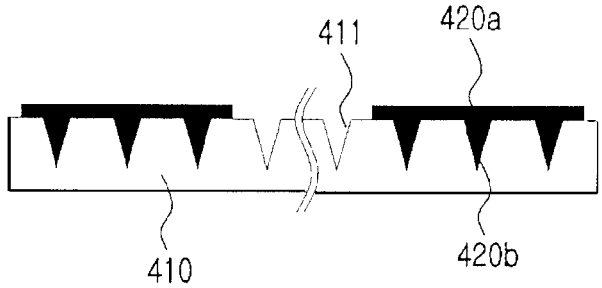

Referring to FIG. 4*b*, the recess 411 is formed by scratching or etching the upper surface of the light guide plate 410. Alternatively, the recess 411 may be formed concurrently when the light guide plate 410 is shaped. The recess 411 provides an interface between the light guide plate 410 and its external air layer, which intersects the path of light propagating inside the light guide plate 410. As a result, light guided towards the second lateral surface of the light guide plate 410 is reflected into the light guide plate 410 by the recess 411.

The light blocking layer 420*a* is formed between the second lateral surface of the light guide plate 410 and the recess 411 so as to surround the recess 411. Thus, the light blocking layer 420*a* absorbs a portion of light that has passed through the recess 411 and minimizes the leakage of light out of the light guide plate 410. As shown in the sectional view, the light blocking layer 420*a* is printed on notches 420*b*, which are formed on the upper surface of the light guide plate 410, by using black ink, for example.

Figure 4C:
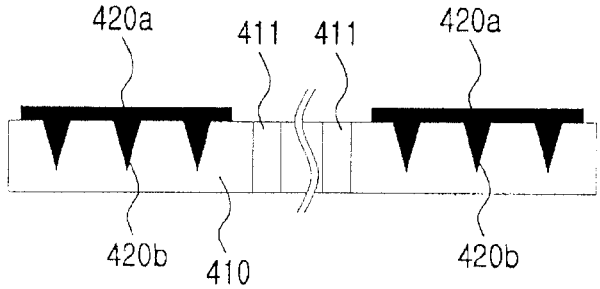

Referring to FIG. 4*c*, the recess 411 is formed as a hole extending through the upper and lower surfaces of the light guide plate 410. The light blocking layer 420*a* has the same structure as in the case of FIG. 4*b*.

Figure 4D:
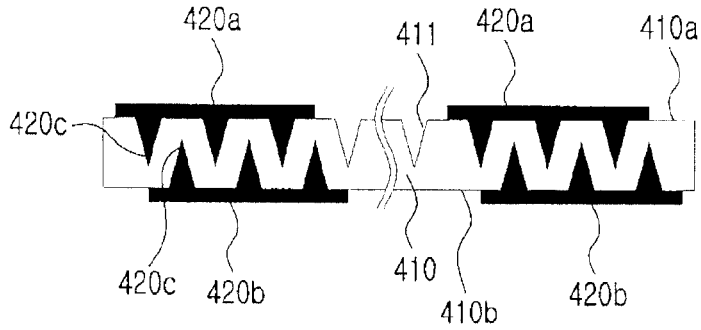

FIG. 4*d* shows the sectional structure of a light guide plate 410 having a recess 411 formed on its upper surface 410*a*, as in the case of FIG. 4*b*. The light guide plate 410 also has light blocking layers 420 and 420*b* filling notches 420*c* formed on the upper and lower surfaces 410*a* and 410*b* of the light guide plate 410.

Figure 4E:
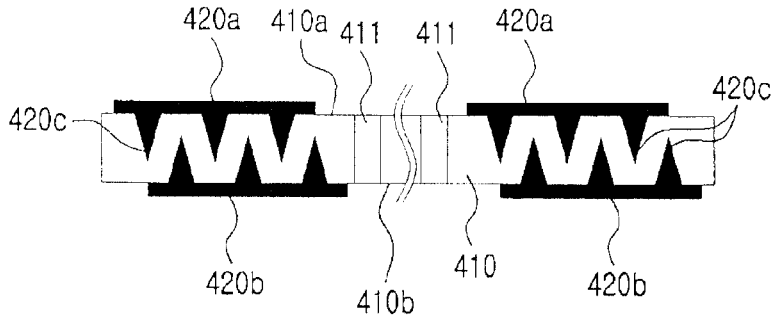

FIG. 4*e* shows the sectional structure of a light guide plate 410 having a recess 411 extending through the upper and lower surfaces 410*a* and 410*b* of the light guide plate 410. The light guide plate 410 also has light blocking layers 420*a* and 420*b* printed on notches 420*c* formed on the upper and lower surface 410*a* and 410*b* in an alternating diagonal or zigzag pattern.

Figure 5:
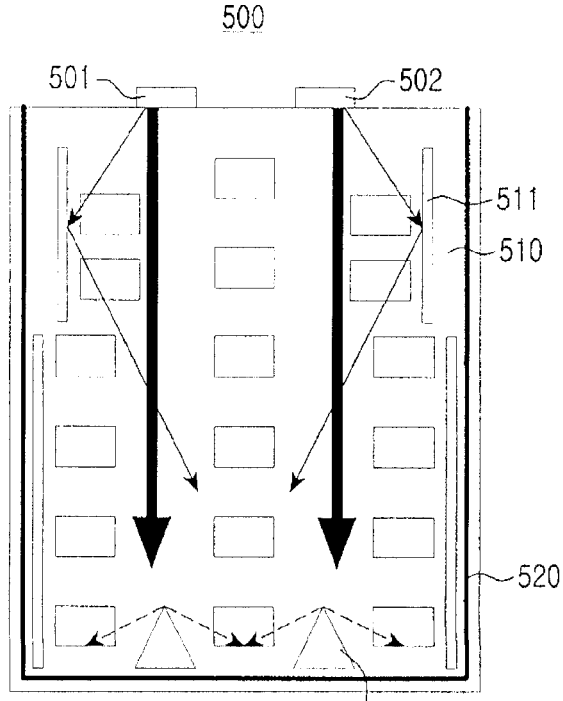
FIG. 5 shows a light guide member according to a fifth embodiment of the present invention.

FIG. 5 shows a light guide member according to a fifth embodiment of the present invention. Referring to FIG. 5, the light guide member 500 includes at least one light source 501 and 502, a light guide plate 510 having a first lateral surface positioned to face the light sources 501 and 502, a plurality of recesses 511 and 512 formed in the light guide plate 510, and a light blocking layer 520 formed around the second lateral surface of the light guide plate 510, as well as between the recesses 511 and 512.

The light guide plate 510 has at least one reflection pattern formed on its upper or lower surface by scratching or printing. Alternatively, the reflection pattern may be formed concurrently when the light guide plate 510 is shaped. The reflection pattern causes a portion of light, which has been propagating inside the light guide plate 510, to undergo irregular reflection so that it is reflected towards the upper or lower surface of the light guide plate 510.

The recesses 511 and 512 may be holes extending through the upper and lower surfaces of the light guide plate 510. Alternatively, the recesses 511 and 512 may be indentations formed on the upper or lower surface of the light guide plate 510 by scratching, or formed concurrently when the light guide plate 510 is shaped.

Figure 6:
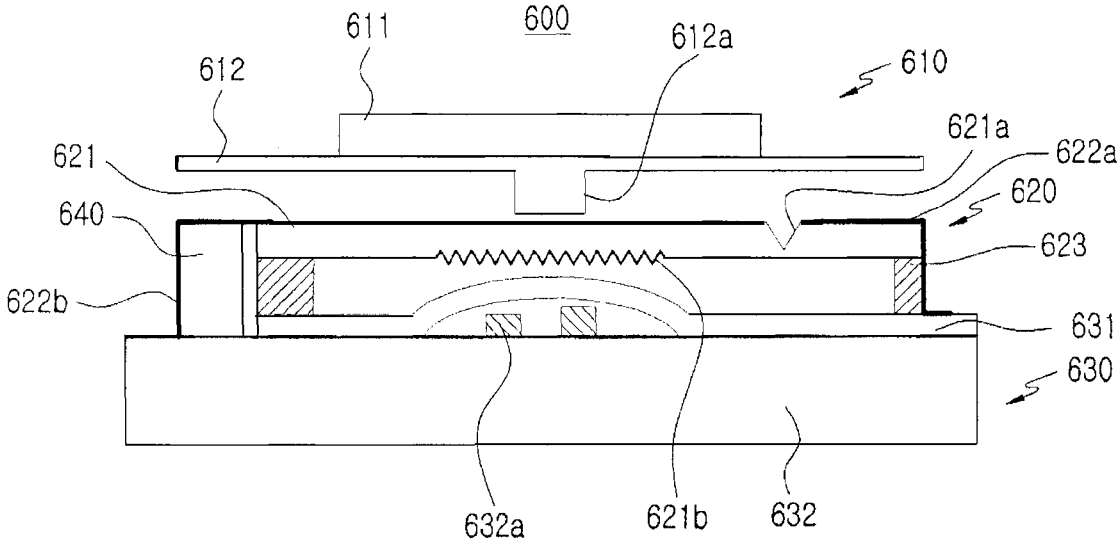
FIG. 6 shows the section of a keypad assembly according to a sixth embodiment of the present invention.

FIG. 6 shows the section of a keypad assembly according to a sixth embodiment of the present invention. The keypad assembly 600 may be mounted in a portable wireless terminal. The keypad assembly 600 includes a keypad 610, a switch pad 630 positioned to face the keypad 610, at least one light source 640, and a light guide member 620 positioned between the switch pad 630 and the keypad 610. The light source 640 is covered with a light blocking layer 622*b*, except for its light emitting surface.

The keypad 610 includes an elastic sheet 612 and at least one key button 611 positioned on the elastic sheet 612. The elastic sheet 612 may have a compression protrusion 612*a* protruding towards the light guide member 620. When the user presses the key button 611, the compression protrusion 612*a* transmits the resulting pressure to the switch pad 630. In addition, the compression protrusion 612*a* transmits repulsive force from the switch pad 630 to the user so that he/she can recognize whether or not the corresponding switch has established a contact.

The elastic sheet 612 may have the shape of an approximately square plate, as well as other shapes. The elasticity of the elastic sheet 612 guarantees that, after the key button 611 has been pressed by the user, it can return to the original position. In particular, the self-restoring capability of the elastic sheet 612 enables the key button 612 to regain its original shape after it has been pressed.

The elastic sheet 612 has a compression protrusion 612*a* positioned vertically below the key button so that, when the key button 612 is pressed, the resulting pressure is transmitted to the switch pad 630. Then, the user can recognize whether or not the switch pad 630 has been pressed.

The key button 611 is positioned on the upper surface of the elastic sheet 612. The key button 611 may be attached to the elastic sheet 612 by adhesive, or formed as an integral unit with the elastic sheet 612 by injection molding. The key button 611 may be made of the same material as the elastic sheet 612. Alternatively, the key button 611 may be made of polycarbonate or acrylic resin. Although the key button 611 according to the present embodiment has the shape of a square block, it may have another shape, such as a circular post or an elliptical post.

The light guide member 620 includes a light guide plate 621 for guiding light coupled to its inside, at least one recess 621*a* for diffusing light coupled to the inside of the light guide plate 621, and light blocking layers 622*a* and 622*b*. The light blocking layer 622*b*, which surrounds the light source 640, may be made of black tape, for example. The light blocking layer 622*a*, which surrounds the light guide plate 621, may be formed by black ink printing, for example.

The light guide plate 621 includes a reflection pattern 621*b* for reflecting a portion of light, which has been coupled to the inside, to the key button 611, a recess 621*a* for preventing light, which has been guided inside, from leaking out, and light blocking layers 622*a* and 622*b*. The light guide plate 621 causes light, which has been coupled to the inside via the first lateral surface facing the light source 640, to undergo total reflection at the interface of the upper and lower surfaces with the external air layer so that the light is guided towards the second lateral surface (which is opposite to the first lateral surface). The reflection pattern 621*b* may be formed on the upper or lower surface of the light guide plate 621 by scratching. Alternatively, the reflection pattern 621*b* may be formed as an indentation concurrently when the light guide plate 621 is shaped.

If light that has been propagated inside the light guide plate 621 after total reflection is incident on the reflection pattern 621*b*, the condition of total reflection is not satisfied by the reflection pattern 621*b* (when the incident angle is smaller than the critical angle). Then, the light passes through the light guide plate 621 and the elastic sheet 612, and illuminates the key button 611.

The light guide plate 621 preferably has a small thickness (for example, 0.1-0.3 mm) for slimness of the keypad assembly 600. When the light guide plate 621 is made of polycarbonate or PMMA, for example, it may have a thickness of 0.1-0.2 mm. When the light guide plate 621 is made of polyurethane or silicone, it may have a thickness of 0.1-0.3 mm.

When light coupled to the inside of the light guide plate 621 leaks out of the light guide plate 621 instead of illuminating the key button, light leakage occurs. When such light leakage occurs, the luminance necessary to illuminate the key button 611 decreases because light leaks unnecessarily.

Light coupled to the inside of the light guide plate 621 undergoes total reflection at the interface of the light guide plate 621 (particularly, its upper and lower surfaces) with its external air layer, and propagates inside the light guide plate 621. The recess 621*a* is formed in a direction perpendicular to the direction in which light is guided inside the light guide plate 621 so that an interface with the external air layer is created inside the light guide plate 621. As a result, light guided inside the light guide plate 621 is reflected to the light guide plate 621 at the interface defined by the recess 621*a*.

In order to ensure that light coupled to the inside of the light guide plate 621 illuminates the key button 611 without leaking out of the light guide plate 621, the light blocking layer 622*a* surrounds the lateral surfaces of the light guide plate 621, except for its lateral surface (which faces the light source 640) on which light is incident. The light blocking layer 622*a* may be formed through a printing process using black ink, which absorbs light, so that light leakage is suppressed. It is also possible to print a surface of the light blocking layer 622*a*, which abuts corresponding lateral surfaces of the light guide plate 621, with white link so that light incident on the light blocking layer 622*a* is reflected towards the light guide plate 621.

As has been described with reference to the first to fifth embodiments of the present invention (FIGS. 1*a*, 2*a*, 3*a*, 4*a*, and 5), the light blocking layer 622*a* is formed inside the light guide plate 621 along the lateral surfaces of the light guide plate 621. This is true except for its lateral surface on which light is incident, so as to minimize the leakage of light, the path of which has been modified by the recess 621*a*.

The recess 621*a* and the light blocking layer 622*a* may adopt the structure according to one of the first to fifth embodiments of the present invention.

The switch pad 630 includes a PCB 632 having electric contacts 632*a* formed thereon. A dome sheet 631 is bonded to the PCB 632 and provided with domes corresponding to the electric contacts 632*a*.

The dome sheet 631 may be made of a thin conductive material so that, when the user presses the key button 611, corresponding dome and electrical contact 632 are electrically connected to each other. The dome sheet 631 may be attached to the PCB 632 with adhesive, for example.

A support member 623 may be inserted between the light guide plate 621 and the dome sheet 631. The support member 623 may have the shape of a ring, such as a square strip. The support member 623 is attached to the peripheral or inner portion of the light guide plate 621. The support member 623 may consist of double-sided tape, adhesive, or a sticky printed layer.

As mentioned above, the light guide member according to the present invention has at least one recess formed in a direction perpendicular to the propagation path of light so that light coupled to the inside of the light guide member can be guided in a direction different from the initial direction of propagation. Therefore, light coupled to the inside of the light guide plate can be diffused over the entire light guide plate. This uniforms and improves the luminance for illuminating the key button. In addition, the light blocking layer formed around the recess minimizes the loss of light.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A light guide member comprising:

a light guide plate for propagating light therethrough; and at least one recess formed in a direction perpendicular to a direction of guidance of light coupled to the inside of the light guide plate so that light guided by the light guide plate is reflected into the light guide plate;

at least one notch formed on an upper surface or a lower surface of the light guide plate; and a first light blocking layer filled in the notch, wherein the first light blocking lamer absorbs light that has passed through the notch.

2. The light guide member as claimed in claim 1, wherein a section of the recess taken in a direction perpendicular to the direction of guidance of light guided by the light guide plate has a predetermined curvature or has a polygonal shape.

3. The light guide member as claimed in claim 1, wherein the recess is an indentation formed on a part of a lateral surface of the light guide plate or a hole extending through upper and lower surfaces of the light guide plate.

4. The light guide member as claimed in claim 1, further comprising a light blocking layer surrounding lateral surfaces of the light guide plate except for one lateral surface, wherein light is incident on the one lateral surface.

5. The light guide member as claimed in claim 1, wherein the recess extends through upper and lower surfaces of the light guide plate.

6. A keypad assembly comprising:

a keypad having at least one key button and an elastic sheet fixing the key button;

a light guide member positioned beneath the keypad, the light guide member having a light guide plate for propagating light therethrough, at least one recess formed in a direction perpendicular to a direction of guidance of light coupled to the inside of the light guide plate so that light guided by the light guide plate is reflected into the light guide plate, at least one notch formed on an upper surface or a lower surface of the light guide plate, and a first light blocking layer filled in the notch, wherein the first light blocking layer absorbs light that has passed through the notch; and a switch pad positioned beneath the light guide member so as to establish an electric contact when the key button is pressed.

7. The keypad assembly as claimed in claim 6, further comprising a second light blocking layer surrounding lateral surfaces of the light guide plate except for one lateral surface, wherein light is incident on the one lateral surface.

8. The keypad assembly as claimed in claim 6, wherein the recess extends through upper and lower surfaces of the light guide plate.

9. The keypad assembly as claimed in claim 6, wherein the switch pad comprises:

a printed circuit board having a plurality of electric contacts formed thereon; and a dome sheet bonded to the printed circuit board, the dome sheet having domes corresponding to the electric contacts, respectively.

10. The keypad assembly as claimed in claim 6, further comprising a light source for creating light to be coupled to a lateral surface of the light guide plate.

11. The keypad assembly as claimed in claim 6, wherein the recess is formed in a direction perpendicular to a direction of guidance of light coupled to the inside of the light guide plate so as to create an interface between the light guide plate and the atmosphere.

12. The keypad assembly as claimed in claim 6, further comprising:

a light source for creating light to be coupled to the inside of the light guide plate; and a second light blocking layer formed on upper and lateral surfaces of the light source.

13. The keypad assembly as claimed in claim 6, wherein the recess is an indentation formed on a part of a lateral surface of the light guide plate or a hole extending through upper and lower surfaces of the light guide plate.

14. The keypad assembly as claimed in claim 6, wherein the elastic sheet includes a compression protrusion that transmits resulting pressure to the switch pad and repulsive force from the switch to a user to indicate the switch pad has been pressed.

* * * * *

UNITED STATES PATENT AND TRADEMARK OFFICE

CERTIFICATE OF CORRECTION

PATENT NO. : 8,052,318 B2
APPLICATION NO. : 13/038521
DATED : November 8, 2011
INVENTOR(S) : Joo-Hoon Lee et al.

It is certified that error appears in the above-identified patent and that said Letters Patent is hereby corrected as shown below:

Column 8, Claim 1, Lines 22-23 should read as follows:
-- ...light therethrough; at least... --

Column 8, Claim 1, Line 30 should read as follows:
-- ...light blocking layer absorbs... --

Signed and Sealed this
Seventeenth Day of July, 2012

David J. Kappos

David J. Kappos
*Director of the United States Patent and Trademark Office*